US007440575B2

(12) United States Patent
Kirkeby

(10) Patent No.: US 7,440,575 B2
(45) Date of Patent: Oct. 21, 2008

(54) EQUALIZATION OF THE OUTPUT IN A STEREO WIDENING NETWORK

(75) Inventor: Ole Kirkeby, Espoo (FI)

(73) Assignee: Nokia Corporation, Espoo (FI)

( * ) Notice: Subject to any disclaimer, the term of this patent is extended or adjusted under 35 U.S.C. 154(b) by 686 days.

(21) Appl. No.: 10/720,009

(22) Filed: Nov. 21, 2003

(65) Prior Publication Data

US 2004/0136554 A1 Jul. 15, 2004

(30) Foreign Application Priority Data

Nov. 22, 2002 (FI) ..... 20022092

(51) Int. Cl.
*H04R 5/00* (2006.01)

(52) U.S. Cl. ..... 381/1; 381/17; 381/18

(58) Field of Classification Search ..... 381/1, 381/17–20, 309, 11–12
See application file for complete search history.

(56) References Cited

U.S. PATENT DOCUMENTS

| | | | | |
|---|---|---|---|---|
| 4,087,629 | A * | 5/1978 | Atoji et al. | 381/63 |
| 4,139,728 | A * | 2/1979 | Haramoto et al. | 381/1 |
| 4,748,669 | A | 5/1988 | Klayman | 381/1 |
| 5,850,454 | A * | 12/1998 | Hawks | 381/1 |
| 5,862,227 | A | 1/1999 | Orduna-Bustamante et al. | |
| 5,892,830 | A | 4/1999 | Klayman | 381/1 |
| 5,912,976 | A * | 6/1999 | Klayman et al. | 381/18 |
| 6,111,958 | A | 8/2000 | Maher | |
| 6,507,657 | B1 | 1/2003 | Kamada et al. | 381/17 |
| 6,614,910 | B1 * | 9/2003 | Clemow et al. | 381/1 |
| 6,771,778 | B2 * | 8/2004 | Kirkeby | 381/17 |
| 7,254,239 | B2 * | 8/2007 | Fincham | 381/17 |
| 2002/0097880 | A1 * | 7/2002 | Kirkeby | 381/1 |
| 2002/0154783 | A1 * | 10/2002 | Fincham | 381/17 |
| 2003/0219130 | A1 * | 11/2003 | Baumgarte et al. | 381/17 |

FOREIGN PATENT DOCUMENTS

| | | |
|---|---|---|
| EP | 0955789 | 11/1999 |
| EP | 1194007 | 4/2002 |
| WO | 9700594 | 1/1997 |
| WO | 03053099 | 6/2003 |

* cited by examiner

*Primary Examiner*—Vivian Chin
*Assistant Examiner*—Disler Paul

(57) ABSTRACT

The invention relates to a method, signal processing device and computer program for stereo widening (SW) of stereo format signals to become suitable for headphone listening. The invention also relates to a mobile appliance performing signal processing according to the invention. According to the invention a separate monophonic signal path (ME) is formed in order to equalize the frequency spectrum of the monophonic component of the left and right output signals ($L_{out}$,$R_{out}$) by at least extracting from the left and right input signals ($L_{in}$,$R_{in}$) an at least substantially monophonic signal component contained in said signals ($L_{in}$,$R_{in}$), processing the extracted monophonic signal component to obtain a processed monophonic signal component, and combining said processed monophonic signal component with at least one of the left ($L_{out}$) or the right ($R_{out}$) output signals.

24 Claims, 5 Drawing Sheets

EQUALIZATION OF THE OUTPUT IN A STEREO WIDENING NETWORK

CROSS-REFERENCE TO RELATED APPLICATIONS

This application claims priority under 35 USC §119 to Finnish Patent Application No. 20022092 filed on Nov. 22, 2002.

1. Field of the Invention

The present invention relates to a method for converting stereo format signals to become suitable for playback using headphones. The invention also relates to a signal processing device for carrying out said method. The invention further relates to a computer program comprising machine executable steps for carrying out said method. Finally, the invention relates to a mobile appliance with audio capabilities.

2. Background of the Invention

Already for several decades the prevailing format for making music and other audio recordings and public broadcasts has been the well-known two-channel stereo format. The two-channel stereo format consists of two independent tracks or channels; the left (L) and the right (R) channel, which are intended for playback using separate loudspeaker units. Said channels are mixed and/or recorded and/or otherwise prepared to provide a desired spatial impression to a listener, who is positioned centrally in front of two loudspeaker units spanning ideally 60 degrees with respect to the listener. When a two-channel stereo recording is listened through the left and right loudspeakers arranged in the above described manner, the listener experiences a spatial impression resembling the original sound scenery. In this spatial impression the listener is able to observe the direction of the different sound sources, and the listener also acquires a sensation of the distance of the different sound sources. In other words, when listening to a two-channel stereo recording, the sound sources seem to be located somewhere in front of the listener and inside the area located somewhere between the left and the right loudspeaker units.

Other audio recording formats are also known, which, instead of only two loudspeaker units, rely on the use of more than two loudspeaker units for the playback. For example, in a four channel stereo system two loudspeaker units are positioned in front of the listener: one to the left and one to the right, and two other loudspeaker units are positioned behind the listener: to the rear left and to the rear right, respectively. Further, a separate fifth channel/loudspeaker may be provided for the low frequency sounds.

Such multichannel arrangements are nowadays commonly used, e.g., in computer games, in movie theatres or even in home entertainment systems. This allows to create a more detailed spatial impression of the sound scenery, where the sounds can be heard coming not only somewhere from the area located in front of the listener, but also from behind, or directly from the side of the listener. Recordings for these multichannel systems can be prepared to have independent tracks for each separate channel, or the information of the "extra" channels in addition to a normal two-channel stereo format can also be coded into the left and right channel signals in a two-channel stereo format recording. In the latter case a special decoder is required during the playback to extract the signals, for example, for the rear left and rear right channels. Digital Video Disc (DVD) products, for example, support the aforementioned multichannel sound arrangements.

Further, some special methods are known in order to prepare recordings, which are specially intended to be heard over headphones. These include, for example, binaural signals that are made by recording signals corresponding to the pressure signals that would be captured by the eardrums of a human listener in a real listening situation. Such recordings can be made for example by using a dummy-head, which is an artificial head equipped with two microphones replacing the two human ears. When a high-quality binaural recording is heard over headphones, the listener experiences the original, detailed three-dimensional sound image of the recording situation. Binaural signals can also be synthesized without the need for making a real-life recording.

SUMMARY OF THE INVENTION

The present invention is mainly related to such general two-channel stereo recordings, broadcasts or similar audio material, which have been mixed and/or otherwise prepared to be played back over two loudspeaker units, which said units are intended to be positioned in the previously described manner with respect to the listener. Hereinbelow, the use of the short term "stereo" refers to aforementioned kind of two-channel stereo format. Listening to audio material in such stereo format played back over two loudspeakers is hereinbelow shortly referred to as "natural listening".

When a stereo recording is played back over loudspeakers in a natural listening situation, the sound emitted from the left loudspeaker is heard not only by the listener's left ear but also by the right ear, and correspondingly the sound emitted from the right loudspeaker is heard both by the right and left ear. This condition is of primary importance for the generation of a hearing impression with a correct spatial feeling. In other words, this is important in order to generate a hearing impression in which the sounds seem to originate from a space or stage outside the listener's head. When listening to a stereo recording over headphones, the left channel is heard in the left ear only, and the right channel is heard in the right ear only. This causes the hearing impression to be both unnatural and tiresome to listen to, and the sound scenery or stage is contained entirely inside the listener's head: the sound is not externalised as intended.

There are reasons to support such an opinion that when a recording in normal stereo format is played back over headphones directly without any spatial conversion, the above described unnatural spatial impression may cause listening fatigue. Therefore, in order to compensate for the unnatural listening conditions experienced when using headphones, so-called spatial enhancers, or stereo widening networks are known from the related art.

The basic idea behind most spatial enhancers or stereo widening systems is that the sound heard by the listener over headphones should be very similar to the sound the listener would have heard, if the music had been played back over two widely spaced loudspeakers. In other words, the stereo signals played back through the headphones are processed in order to create in the listener's ears an impression of the sound coming from a pair of "virtual loudspeakers", and thus further resembling the listening to the real original sound sources. Methods belonging to this category are referred later in this text as "virtual loudspeaker methods".

An earlier published patent application EP 1194007 by the Applicant discloses a stereo widening network based on the aforementioned virtual loudspeaker-type approach. Said stereo widening network is thus capable of externalising the sounds so that the listener experiences the sound scenery or stage to be located outside his/her head in a manner similar to a natural listening situation.

FIG. 1 illustrates schematically an example of a stereo widening network relying on the virtual loudspeaker approach. In order to conceptually understand the operation, of the stereo widening network shown in FIG. 1, one can consider the following. Input signals L and R represent stereo format signals that are in a natural listening situation fed directly to a pair of loudspeakers. Sound emitted by the left loudspeaker is then heard at both ears, and, similarly, sound emitted by the right loudspeaker is also heard at both ears. Consequently, in a natural listening situation there are four acoustical paths from the two loudspeakers to the two ears, i.e. two so-called direct paths and two so-called cross-talk paths. These acoustical paths have their corresponding signal paths in a stereo widening network.

When the loudspeakers are positioned symmetrically with respect to the listener, the direct path from the left speaker to the left ear is the same as the direct path from the right speaker to the right ear, and, similarly, the cross-talk from left speaker to the right ear is the same as the cross-talk from the right speaker to the left ear. In FIG. 1 we denote the identical direct paths by subscript 'd' and the identical cross-talk paths by subscript 'x'. The direct path and the cross-talk path each has a discrete-time transfer function, $H_d(z)$ and $H_x(z)$ associated with it, respectively. The cross-talk path transfer functions $H_x(z)$ include a delay term, which simulates the path length difference between the direct and cross-talk paths. In other words, in a natural listening situation, for example, the sound from the left speaker arrives to the right ear (cross-talk path) slightly later than to the left ear (direct path). It can be readily understood, that the aforementioned delay generated by the stereo widening network between the direct and cross-talk paths plays a very important role in creating correct spatial hearing impression in headphone listening. As familiar for a person skilled in the art, the difference between the time delays in the direct path and the cross-talk path corresponds to the interaural time difference (ITD), and the difference between the gains in the direct path and the cross-talk path corresponds to the interaural level difference (ILD). The ILD is dependent on the frequency whereas the ITD is not.

Unfortunately, the human auditory system is extremely sensitive to any modifications made to a high-quality music recording. Artifacts of any kind introduced in spatial processing are readily picked up, even by rather inexperienced listeners. Consequently, it is advantageous to be able to ensure that a spatial enhancer or stereo widening network does not do any harm to the quality of the original recording.

One of the most prominent elements of a stereo recording is the monophonic component. As well known for a person skilled in the art, the monophonic component is the part of the signal which is common for both to the L and R channels, and which is therefore in a natural listening situation heard at the centre of the sound stage. The lead vocals on a pop recording, for example, are usually positioned at the centre of the sound stage.

When stereo sound signals L,R including a prominent monophonic component is processed using a prior art type stereo widening network illustrated in FIG. 1, causes this significant attenuation of the monophonic signals at certain frequencies or frequency bands. This is because when a delay is added into the cross-talk path signal by $H_x(z)$, in certain situations this generates a signal that has substantially similar waveform to the signal present in the direct path but with substantially opposite phase. When the direct path and cross-talk path signals corresponding to the monophonic component are summed up together, the aforementioned phase difference between these signals causes attenuation of the monophonic component at certain frequencies or frequency bands. Later in this text this effect is referred shortly to as destructive interference.

The aforementioned unwanted modification of the monophonic signal component as a result of the spatial processing is unacceptable to many listeners, and this motivates the design of a signal processing method that can alleviate this problem. According to the Applicant's point of view, this problem has not been solved satisfactorily in prior art designs.

U.S. Pat. No. 6,111,958 presents audio spatial enhancement apparatus and methods, which try to reduce the unwanted effects of the spatial processing to the monophonic component by generating a pseudo-stereo signal prior to the actual spatial broadening. The aforementioned document refers to the so-called sum-difference processing which does not insert any binaural cues, and which is therefore not relevant to headphone listening applications.

WO-publication 97/00594 discloses method and apparatus for spatially enhancing stereo and monophonic components. This solution, which is based on the use of analog electronic circuits, utilizes also the idea of a pseudo-stereo signal synthesized from the monophonic signal in order to further spatially enhance the monophonic component. Such approach, however, leads to unavoidable degradation of the quality of the original recording.

The main purpose of the present invention is to introduce a novel and simple solution for spatial processing of stereo format signals to become suitable to be played back using headphones in a manner ensuring that also the monophonic component of said stereo signals can be perceived substantially free of disturbing artifacts. In a broad sense, the invention is applicable to such situations where the stereo format audio material is to be listened to using headphones, i.e. the audio material is provided as separate left and right channel signals. The audio material may have been provided directly as a two-channel stereo recording, or it may have been converted to such a two-channel format from some other format known as such.

The current invention specifies a signal processing approach, preferably based on digital signal processing, for equalizing the output from a spatial enhancer system in such a way that the amplitude spectrum of the monophonic component of the output signals can be maintained flatter than in some prior art methods. This ensures that the spatial impression of the spatially enhanced signals in a headphone listening situation can be perceived as substantially free of artifacts. This desired effect is produced by adding energy to the output signals from the spatial enhancer, in a slightly delayed manner relative to the direct sound, and within that frequency band where the monophonic signal component needs boosting in order to compensate for the attenuation caused by the above explained destructive interference. According to a preferred embodiment of the invention the gain that determines the level of the added energy can be varied in real-time according to the strength of the monophonic component of the original stereo signals.

According to a first aspect of the invention, a method in stereo widening or corresponding spatial signal processing of stereo format signals to become suitable for headphone listening, comprises at least the steps of forming left and right channel signal paths in order to process the left and right channel input signals into left and right channel output signals, and forming at least one delay introducing cross-talk signal path between the left and right channel signal paths, wherein the method further comprises the step of forming a separate monophonic signal path in order to equalize the frequency spectrum of the monophonic component of the left and right output signals by at least extracting from the left and right input signals an at least substantially monophonic signal component contained in said signals, processing the monophonic signal component to obtain a processed monophonic signal component, and combining said processed monophonic signal component with at least one of the left and the right output signals.

Further according to the first aspect of the invention, the at least substantially monophonic signal component is extracted from the left and right input signals based on the momentary average value (L+R)/2 of said signals.

Still further according to the first aspect of the invention, the at least substantially monophonic signal component is extracted from the left and right input signals based on the similarity between said signals.

Further still according to the first aspect of the invention, the processing of the monophonic signal component includes processing of the frequency spectrum of said signal component.

Still further according to the first aspect of the invention, the processing of the frequency spectrum of said signal component is performed substantially within a frequency range ranging from 500 Hz to 2 kHz.

Further still according to the first aspect of the invention, the processing of the monophonic signal component includes adjustment of the gain of said signal component.

Still further according to the first aspect of the invention, the adjustment of the gain is performed in a time varying manner.

Further still according to the first aspect of the invention, the processing of the monophonic signal component includes adding a delay to said signal.

According to a second aspect of the invention, a signal processing device for stereo widening or corresponding spatial signal processing of stereo format signals to become suitable for headphone listening, comprises at least left and right channel signal paths in order to process the left and right channel input signals into left and right channel output signals, and at least one delay introducing cross-talk signal path between the left and right channel signal paths, wherein the device further comprises separate monophonic signal path in order to equalize the frequency spectrum of the monophonic component of the left and right output signals, said monophonic signal path comprising at least means for extracting from the left and right input signals an at least substantially monophonic signal component contained in said signals, means for processing the monophonic signal component to obtain a processed monophonic signal component, and means for combining said processed monophonic signal component with at least one of the left or the right output signals.

Further according to the second aspect of the invention, the means for extracting the at least substantially monophonic signal component from the left and right input signals are based on determining the momentary average value (L+R)/2 of said signals.

Still further according to the second aspect of the invention, the means for extracting the at least substantially monophonic signal component from the left and right input signals are based on the similarity between said signals.

Further still according to the second aspect of the invention, the means for processing the monophonic signal component include means for processing of the frequency spectrum of said signal component.

Still further according to the second aspect of the invention, the means for processing the frequency spectrum of said signal component comprise a digital Infinite Impulse Response (IIR) or a Finite Impulse Response (FIR) filter structure.

Further still according to the second aspect of the invention, the processing of the frequency spectrum of said signal component is performed substantially within a frequency range ranging from 500 Hz to 2 kHz.

Still further according to the second aspect of the invention, the means for processing the monophonic signal component include means for adjusting the gain of said signal component.

Further still according to the second aspect of the invention, the means for adjusting the gain are arranged to perform the adjustment in a time varying manner.

Still further according to the second aspect of the invention, the means for processing the monophonic signal component include means for adding a delay to said signal.

Further still according to the second aspect of the invention, the device is a digital signal processing device.

According to a third aspect of the invention, a computer program in stereo widening or corresponding spatial signal processing of stereo format signals to process said signals to become suitable for headphone listening, comprises machine executable steps arranged to carry out at least the steps of forming left and right channel signal paths in order to process the left and right channel input signals into left and right channel output signals, forming at least one delay introducing cross-talk signal path between the left and right channel signal paths, and further forming a separate monophonic signal path in order to equalize the frequency spectrum of the monophonic component of the left and right output signals by at least extracting from the left and right input signals an at least substantially monophonic signal component contained in said signals, and processing the monophonic signal component to obtain a processed monophonic signal component, and further combining said processed monophonic signal component with at least one of the left and the right output signals.

Further according to the third aspect of the invention, the computer program is arranged to be executed in a digital signal processor.

According to a fourth aspect of the invention, a mobile appliance with audio capabilities comprising at least signal processing means for stereo widening or corresponding spatial signal processing of stereo format signals to become suitable for headphone listening, comprises at least left and right channel signal paths in order to process the left and right channel input signals into left and right channel output signals, and at least one delay introducing cross-talk signal path between the left and right channel signal paths, wherein the signal processing means further comprise separate monophonic signal path in order to equalize the frequency spectrum of the monophonic component of the left and right output signals, said monophonic signal path comprising at least means for extracting from the left and right input signals an at least substantially monophonic signal component contained in said signals, means for processing the monophonic signal component to obtain a processed monophonic signal component, and means for combining said processed monophonic signal component with at least one of the left or the right output signals.

Further according to the fourth aspect of the invention, the mobile appliance is a portable digital player or a digital mobile telecommunication device.

According to one interpretation the invention can be considered as kind of an add-on module, or as a "third" channel separate from the spatial enhancer or stereo widening network itself. This module or channel equalizes the output from the spatial enhancer in a certain way in order to eliminate or minimize the artifacts otherwise caused by the variation of the amplitude spectrum of the monophonic component. Therefore, listeners will not perceive a significant decrease in sound quality when the invention is applied to spatial processing otherwise used to enhance high-quality music recordings for headphone listening.

The problem related to the behavior of the monophonic component in spatial enhancement for headphone listening has not received very much attention previously. In fact most spatial enhancers according to the related art attempt to achieve a quite dramatic, and therefore rather unnatural effect, and it is usually claimed that listeners prefer this. However, it is the understanding of the Applicant that in the case of high-quality music recordings this is not unconditionally true. Even though preferences vary between individual listeners, there can be found evidence to suggest that many listeners prefer a clean, and therefore natural sound to a heavily processed and spatially "overrich" sound.

The current invention is the first to apply a design constraint, which is related to the sound quality in an objective way. The method and devices according to the invention are more advantageous than prior art methods and devices in avoiding/minimizing unwanted and unpleasant coloration of the reproduced sound especially in the case of high-quality and high-fidelity audio material.

The method according to the invention is especially suitable to be applied together the stereo widening network developed by the Applicant and described in the aforementioned patent application EP 1194007.

However, it should be understood that the invention can be applied together with a wide variety of stereo widening or corresponding spatial signal processing methods, where at least one delay introducing cross-talk signal path is formed between the left and right channel direct signal paths, and thus the aforementioned destructive interference effects may affect the quality of the sound.

The method according to the invention may be implemented using both hardware or software based systems. A considerable advantage of the present invention is that it does not degrade the excellent sound quality available today from digital sound sources as for example CompactDisk players, MiniDisk players, MP3- and AAC-players and digital broadcasting techniques. The processing scheme according to the invention is also sufficiently simple to run in real-time on a portable device, because it can be implemented at modest computational expense.

During the last decade the aforementioned digital portable and personal audio appliances have become increasingly popular. This development has, among other things, strongly increased the use of headphones in the listening of music recordings, radio broadcasts etc. However, the commercially available music recordings and other audio material are still almost exclusively in the two-channel stereo format, and thus intended for playback over loudspeakers and not over headphones. The current invention provides a solution for converting such audio material for headphone listening without degradation of the original high sound quality. The invention can be implemented in a wide variety of different type of portable audio appliances including also different type of wireless communication devices.

The preferred embodiments of the invention and their benefits will become more apparent to a person skilled in the art through the description hereinbelow, and also through the appended claims.

DESCRIPTION OF THE DRAWINGS

In the following, the invention will be described in more detail with reference to the appended drawings, in which.

DETAILED DESCRIPTION OF THE INVENTION

Figure 1:
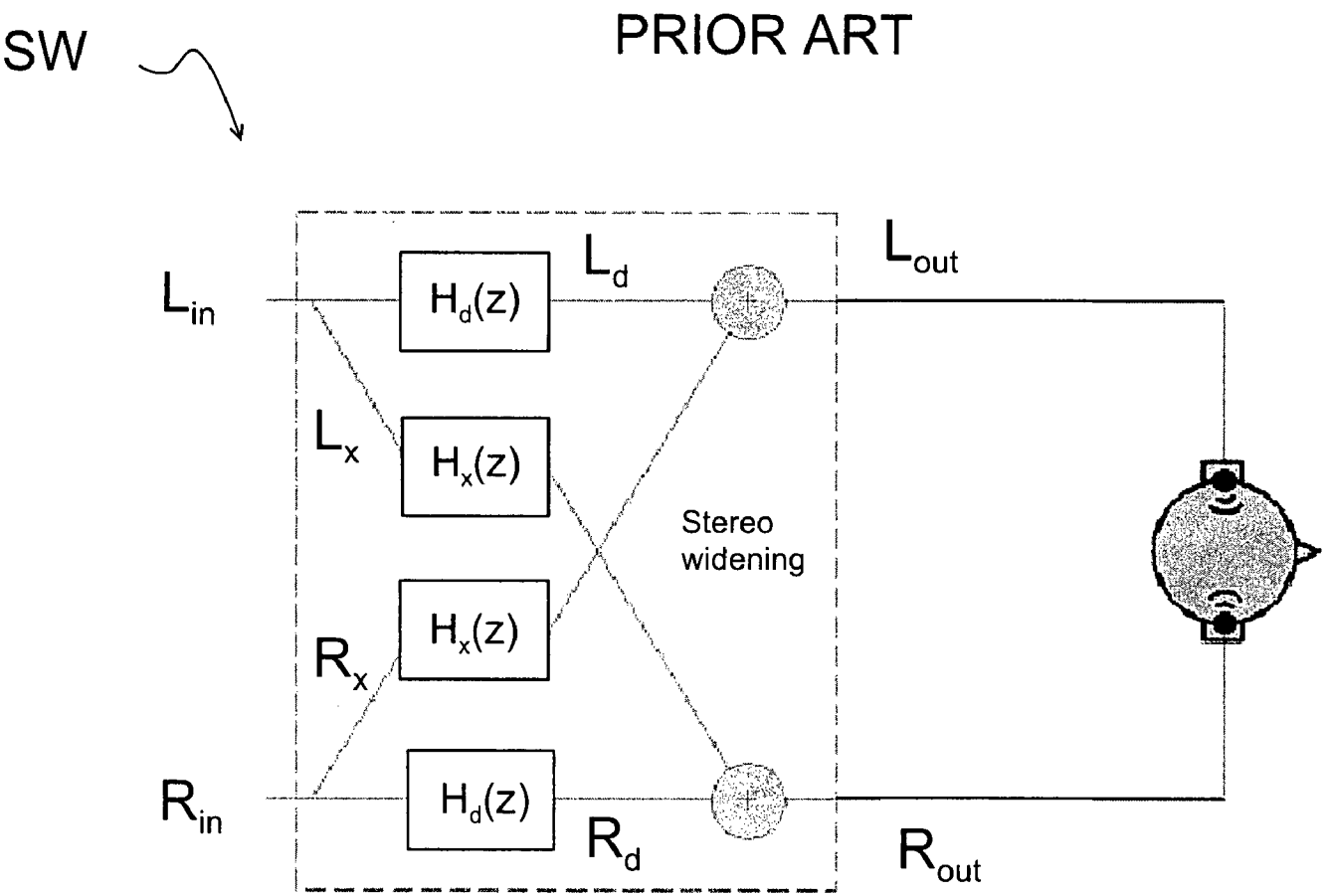
FIG. 1 illustrates schematically a basic prior art type stereo widening network relying on the virtual loudspeaker approach.

FIG. 1 shows a basic prior art type stereo widening network SW relying on the virtual loudspeaker approach. As discussed already above, the direct paths are denoted by subscript 'd' and the cross-talk paths by subscript 'x'. The direct path and the cross-talk path each has a discrete-time transfer function, $H_d(z)$ and $H_x(z)$ respectively. The cross-talk path transfer functions $H_x(z)$ include a delay term in order to create proper spatial hearing impression. The aforementioned patent application EP 1194007 by the Applicant discusses the operation of such a stereo widening network, and especially its preferred balanced embodiment in more details.

Figure 2:
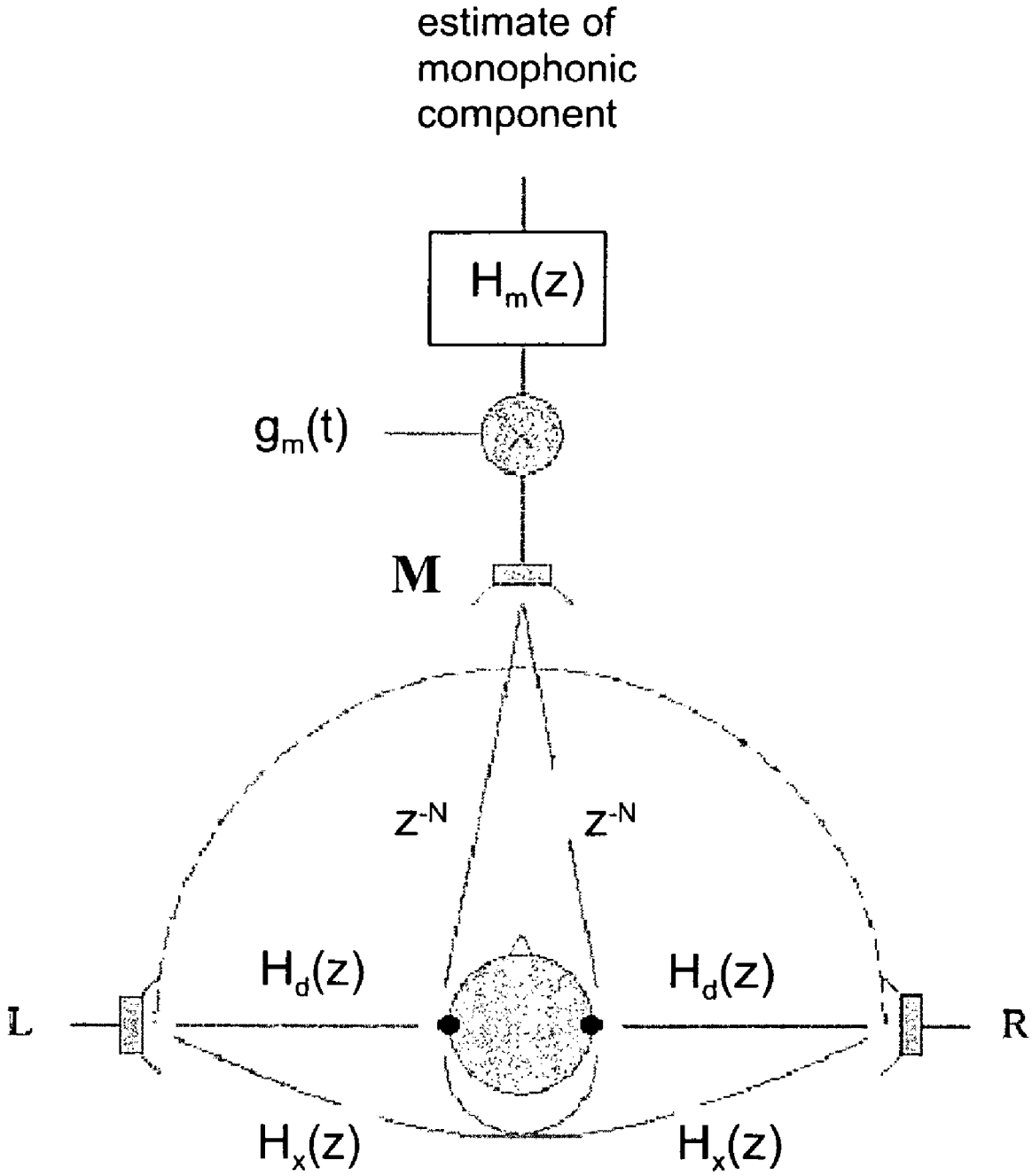
FIG. 2 illustrates schematically the basic idea behind the present invention.

FIG. 2 shows schematically a situation, where the stereo signals L,R are fed to a pair of loudspeakers positioned at straight left and straight right relative to the listener. When the loudspeakers are positioned symmetrically with respect to the listener the direct path from the left speaker to the left ear is the same as the direct path from the right speaker to the right ear, and, similarly, the cross-talk from the left speaker to the right ear is the same as the cross-talk from the right speaker to the left ear. Therefore, the left and right direct path transfer functions $H_d(Z)$ can be taken identical, as well as also the left and right cross-talk path transfer functions $H_x(z)$.

It is readily seen that when the input signals L,R to the two virtual loudspeakers are identical, i.e. monophonic, no sound is reproduced at the listener's ears when $H_d$ is equal in amplitude, but opposite in phase, to $H_x$. In that case the sound propagating along the direct path is canceled completely out by the sound from the cross-talk path due to the earlier discussed destructive interference effects.

In a practical implementation of $H_d$ and $H_x$, when designed for maximum stereo widening where virtual loudspeakers span substantially 180°, the aforementioned attenuation of the monophonic component occurs at frequencies centered around approximately 600 Hz. When virtual loudspeakers span 60° the attenuation occurs just below 2 kHz. The frequencies where the attenuation of the monophonic component takes place depends on the amount of the time delay between the direct and cross-talk paths (interaural time difference ITD), which delay obviously depends on the location and span of the virtual loudspeakers. In principle, severe attenuation of the monophonic component may take place anywhere between 500 Hz and 2 kHz depending on the location and span of the loudspeakers, and the size of the head being modeled.

Therefore, according to the invention the equalizing of the output of the stereo widening network should take place so that the amplitude spectrum of the monophonic component of the output signals can be maintained substantially flat in the aforementioned frequencies. The most obvious use of the monophonic equalizer is to compensate for a dip in the magnitude response at 600 Hz, but for the aforementioned reasons it can be typically useful for compensating for a dip in the magnitude response anywhere between 500 Hz and 2 kHz. Furthermore, it is understandable to a skilled person that the frequency range to be used can in special circumstances be significantly different than the above, for example from 400 Hz to 2.5 kHz. Further, depending on the filtering applied, the monophonic signal may also be amplified somewhat outside the band. Still further, the filtering may cause the amplification of the component to be unequal inside the band, e.g., the band may essentially be split in parts.

In order to better understand the invention in a conceptual manner, one can consider a third virtual loudspeaker M positioned at straight front with respect to the listener (see FIG. 2). Sound emitted from this third loudspeaker M reproduces identical sound pressures at the two ears of the listener. The basic idea of the invention conceptually is to use said speaker M to fill in the missing, attenuated energy in the monophonic component. Thus, the input to this virtual loudspeaker M is ideally a bandpassed version of the monophonic component of signals L and R, optionally modulated by a time-varying gain $g_m$ whose value depends on how similar the stereo signals L and R are. The gain $g_m$ should be large when signals L and R are almost identical, i.e. highly monophonic (low stereophony), and the gain $g_m$ should be small when said signals L,R are very different (high stereophony).

There are various ways to extract an estimate of the amount of the monophonic component, or correspondingly to estimate the amount of stereophony of the signals L,R. One method for estimating the stereophony is presented, for example, in patent publication EP 955789. A simple approach is to use the momentary average (L+R)/2 of the left and right channel signals. The benefit of this approach is that the signal (L+R)/2 can be determined substantially instantaneously. A more sophisticated method could be the use of a coherence function between signals L,R. This may be understood broadly as the use of the history of the two channels in order to obtain an improved estimate of the component common to them, i.e. the similarity or correlation between the channels. This may be achieved, for example, by comparing the spectral values of the channels. For example, if a block of 20 ms of samples of the signals is available, it is possible to calculate the spectrum of both channels, compare them with each other, and keep as the monophonic component only those frequency bands that contain roughly the same amount of energy. Multichannel formats, which are likely to gain widespread use in the future, might provide other ways to extract the monophonic component, and other ways to mix in the monophonic component with the channels that are spatially processed. The 5.1 format, for example, includes a separate center channel.

The center frequency and the bandwidth of the bandpass filter $H_m(z)$ responsible for providing the signal to the third virtual loudspeaker M must be matched to compensate for the attenuation of the monophonic component in the stereo widening network SW. Preferably the third virtual loudspeaker M is positioned slightly further away from the listener than the left and right virtual loudspeakers L,R in order to prevent the narrowing of the soundstage caused by the added central sound source. In terms of signal processing this corresponds to adding a certain delay to the signal corresponding to the third virtual loudspeaker M. The additional delay incorporated in the transfer function $H_m(z)$ in order to do this should be of the order of 1 ms, but its exact value is not critical, and it can be also negative like −1 ms, or for example from −5 ms to 50 ms. It should be noted that in FIG. 2 a common delay is removed, so that the transfer function $H_d(Z)$, which represents the direct path, starts responding at time n=0.

Figure 3:
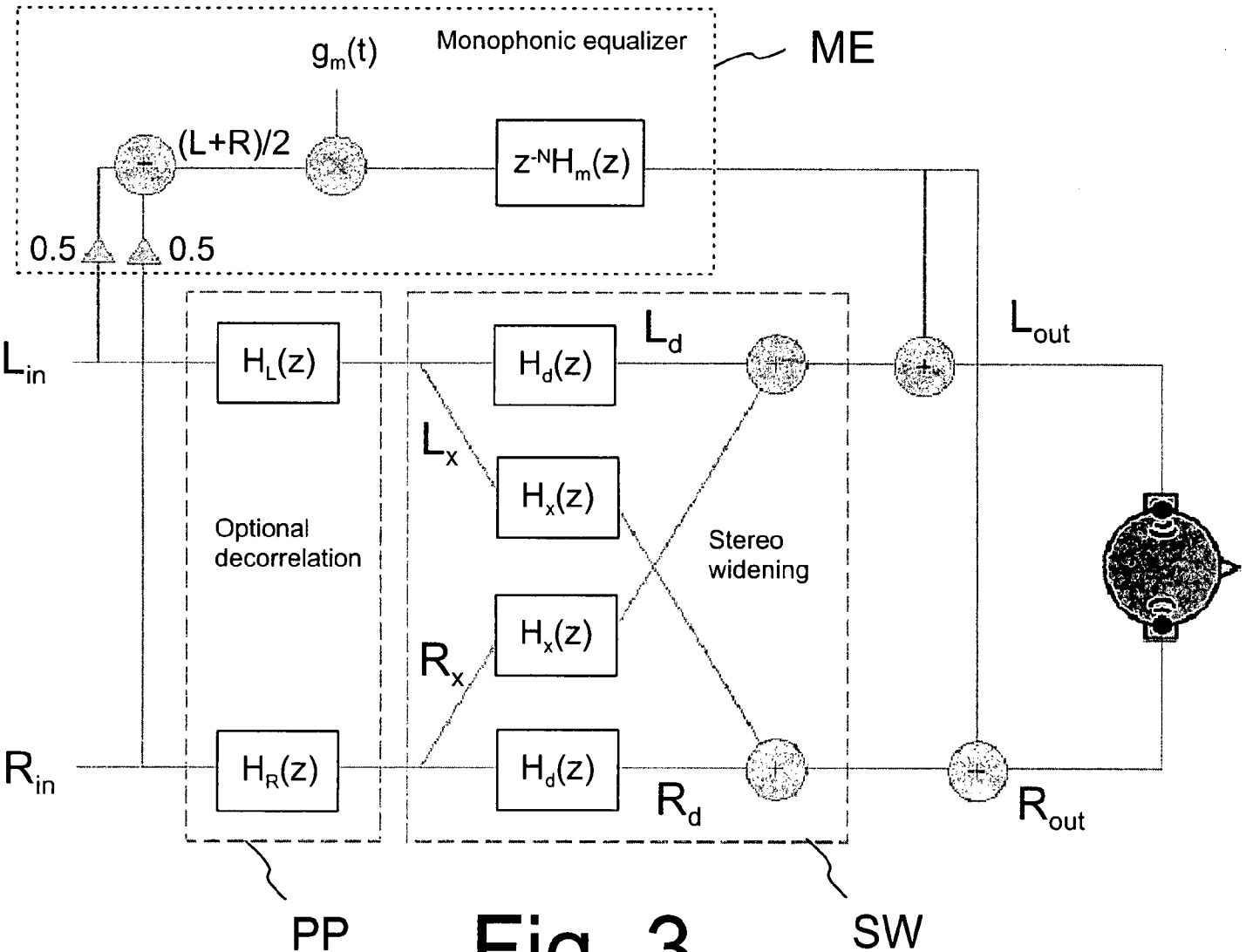
FIG. 3 illustrates schematically a stereo widening network together with a monophonic equalizer module according to the invention, FIG. 4 exemplifies the magnitude response of the monophonic component of a stereo widening network without equalization, FIG. 5 exemplifies the magnitude response of the monophonic component of a stereo widening network equalized according to the invention, FIG. 6 exemplifies the impulse response of a monophonic equalizer module realized using a second order IIR filter, and FIG. 7 exemplifies the magnitude response of a monophonic equalizer module realized using a second order IIR filter.

FIG. 3 shows schematically a block diagram of the monophonic equalizer ME attached as a "third" channel to a stereo widening network SW. FIG. 3 also shows an optional preprocessing block PP in front of the stereo widening network SW for decorrelation of the stereo signals L,R before they enter the actual stereo widening network SW. The role of the preprocessing block PP is discussed in more detail later in this text.

In this example the monophonic component of the stereo signals L,R is estimated by the average signal (L+R)/2. The monophonic equalizer, implemented by the gain $g_m$ which is optionally time-varying, and the digital filter $z^{-N}H_m(z)$ are contained in the "third" channel ME at the top.

$z^{-N}$ is a pure delay of N samples, and $H_m(z)$ is typically a bandpass filter with a gentle cut-on and cut-off slope. Such a filter can be implemented very efficiently by, for example, a second order Infinite Impulse Response (IIR) filter section whose z-transform is given by $$H_m(z) = \frac{b_0 + b_1 z^{-1} + b_2 z^{-2}}{1 + a_1 z^{-1} + a_2 z^{-2}} \tag{1}$$

An example of a suitable set of parameter values at a sample rate of 44.1 kHz are the following:

$b_0$=0.0277,
$b_1$=0,
$b_2$=−0.0277,
$a_1$=−1.93825995619348,
$a_2$=0.94457402736173.

The maximum gain of this IIR filter is 0 dB. Accurate equalization of the monophonic component requires that the overall gain $g_m$ is close to 1 but in practice a value slightly above 0.5, which corresponds to approximately −5 dB, is found to work better. If $g_m$ is increased further, the spatial effect may suffer without any noticeable improvement in the sound quality. The gain $g_m$ may be time varying or given a constant value.

Figure 4:
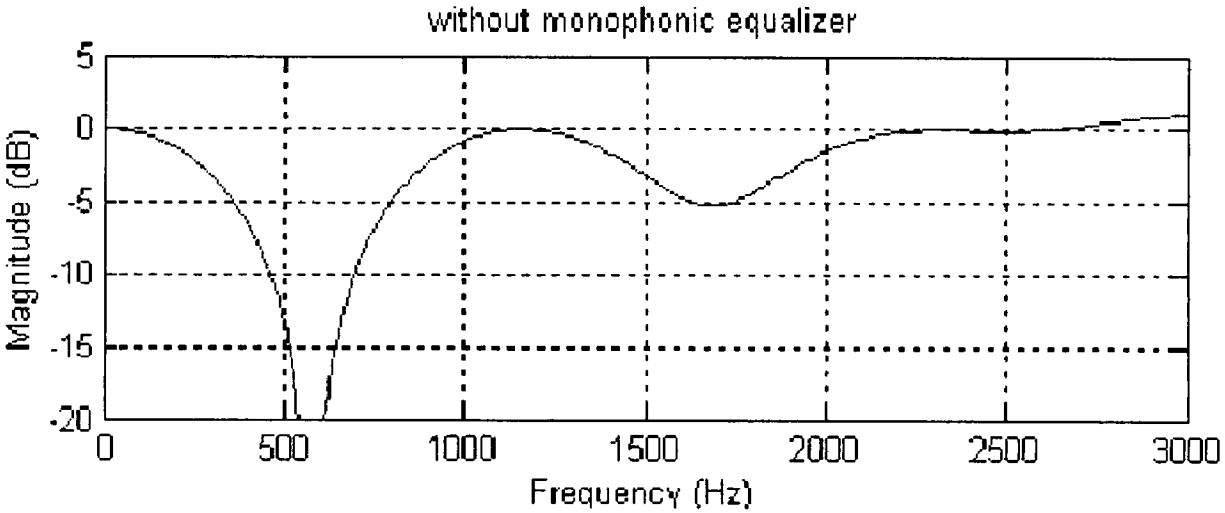
Figure 5:
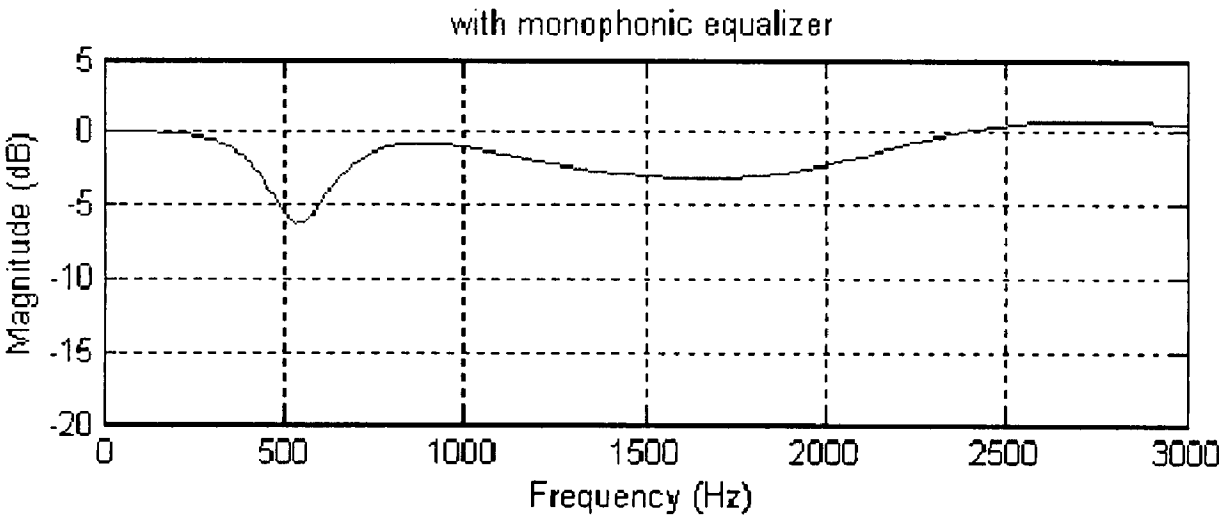

FIGS. 4 and 5 show examples of the magnitude response of a stereo widening network with and without the monophonic equalization according to the invention. The sampling frequency in these examples is taken to be 44.1 kHz, and the equalizer transfer function $H_m(z)$ is a second order IIR filter whose output is delayed 55 samples relative to the $H_d$.

Figure 6:
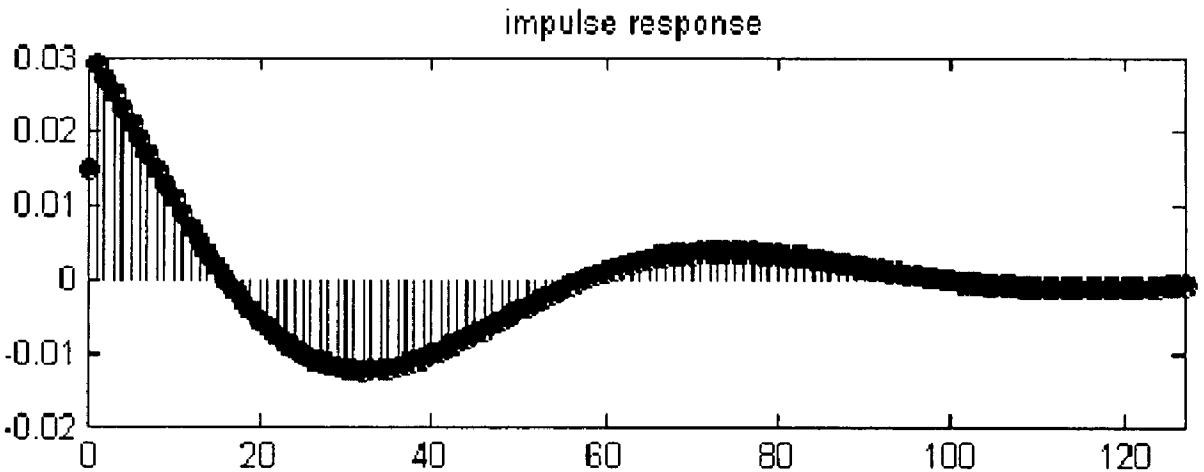
Figure 7:
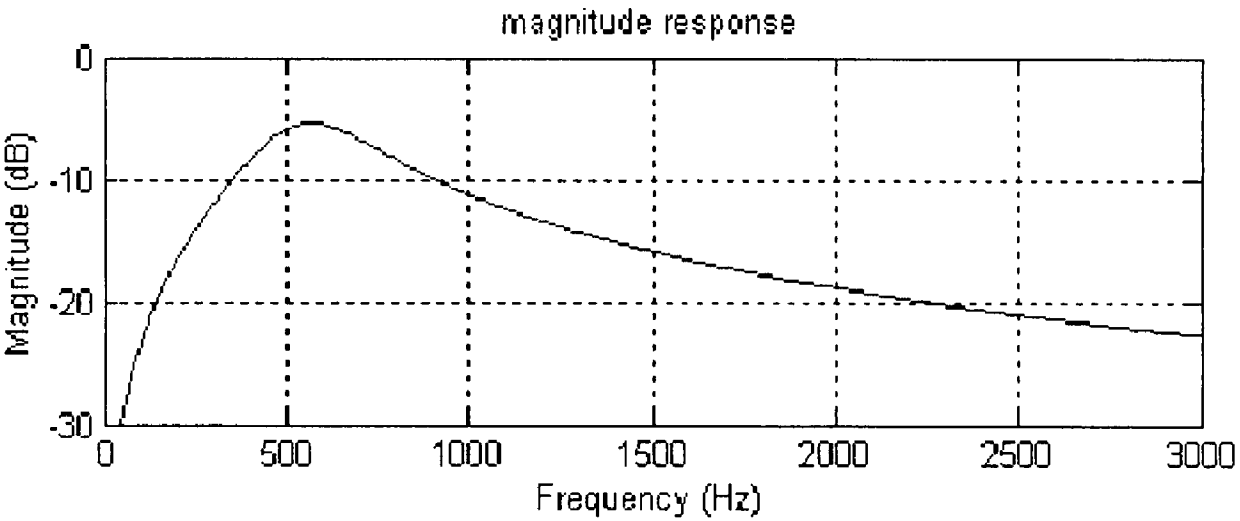

FIGS. 6 and 7 show examples of the impulse response and magnitude response of $H_m(z)$ which is deliberately designed not to achieve very accurate equalization.

It is clear for a person skilled in the art that in floating-point precision it is rather straightforward to implement the second order IIR filter $H_m(z)$ given above. However, implementation of IIR filters in fixed-point precision is notoriously difficult, and for this reason we give here an example of how to run the monophonic equalizer according to the invention using only a very basic instruction set, i.e. software program code on a fixed-point platform such as a Digital Signal Processor (DSP).

It is possible to run the monophonic equalizer without explicit multiplications. However, in order to process 16-bit audio it is necessary to use 32-bit variables internally. The implementation is based on a state variable description whose 2-by-2 feedback matrix contains the real and imaginary parts of the two conjugate poles, which are the roots of the denominator of the transfer function. The real parts are on the diagonal whereas the imaginary parts are off the diagonal, with a positive sign on the element in the lower left corner and a negative sign on the element in the upper right corner. It is much more accurate to approximate the positions of the poles in this way than it is to use the difference equation with coefficients that are approximations to the exact polynomial. This approach makes it possible to choose the pole positions as well as the other values of the parameters in the state variable description so that all multiplications can be calculated by bitshifts and additions. The update equations for the filter $H_m(z)$ are defined by $$\begin{bmatrix} x_1(n+1) \\ x_2(n+1) \end{bmatrix} = \begin{bmatrix} 1-\frac{1}{32} & -\left(\frac{1}{16}+\frac{1}{128}\right) \\ \frac{1}{16}+\frac{1}{128} & 1-\frac{1}{32} \end{bmatrix} \begin{bmatrix} x_1(n) \\ x_2(n) \end{bmatrix} + \begin{bmatrix} 1 \\ 0 \end{bmatrix} u(n) \tag{2}$$

and $$y(n) = \frac{1}{64}\left( \begin{bmatrix} 2 & -1 \end{bmatrix} \begin{bmatrix} x_1(n) \\ x_2(n) \end{bmatrix} + u(n) \right) \tag{3}$$

where $x_1$ and $x_2$ are state variables, u is the input, and y is the output.

An attenuation is built into said filter $H_m(z)$ so that its maximum gain is around −5 dB. Consequently, if u is 16-bit audio signal, then y can also be stored in a 16-bit variable. The state variables $x_1$ and $x_2$, however, must be 32 bit. The parameters listed in Equations 2 and 3 are carefully chosen to ensure sufficient dynamic range without any risk of overflow. There are three or four bits headroom left even when the input is highly compressed pop music, and the signal-to-noise ratio is excellent.

However, it should be noted that optimizing the algorithm is a manual procedure, and it is necessary to go through it again if, for example, the filter $H_m(z)$ has to be designed for another sampling frequency. Therefore the aforementioned should be understood as an example which is not limiting the possible embodiments of the invention.

When the input is purely monophonic, which means that signals L,R are the same, decorrelation can be used to produce a pseudo-stereo signal which is further passed to the stereo widening network. FIG. 3 illustrates the use of an optional pre-processing block PP for decorrelation of the signals L,R prior to the stereo widening network SW. This type of pseudo-stereo processing is often referred to as mono-to-3D. The monophonic equalizer ME according to the invention also works well in this application since it strengthens the center sound image at the frequencies where vocals and lead instruments have a significant part of their energy. The invention improves the overall sound quality at the expense of a slight narrowing of the sound stage, just as it does for two-channel stereo without decorrelation. Thus, the monophonic equalizer ME according to the invention can be used in a 'mild widening' preset for both mono- and stereo inputs.

The monophonic equalizer ME according to the invention can be used in connection with a large variety of different kind of spatial enhancers or stereo widening networks. Preferably, the invention is used in connection with the balanced stereo widening network disclosed in the earlier patent application EP 1194007 by the Applicant. In addition to the monophonic equalizer ME disclosed here, said balanced stereo widening network can further be used together with different type of pre- and/or post-processing methods known as such.

It is therefore obvious for a person skilled in the art that the present invention is not restricted solely to the embodiments presented above, but it can be freely modified within the scope of the appended claims.

It is possible to implement the method according to the invention also by using analog electronics, but it is obvious for anyone skilled in the art that the preferred embodiments are based on digital signal processing techniques. The digital signal processing structures may also be other than IIR structures, for example, Finite Impulse Response (FIR) structures.

In the previous examples the monophonic signal component is first extracted from the left and right input signals, and the bandpass filtering and also other processing steps directed to said signal component are performed after that. However, it is also possible to construct the monophonic signal path ME in such a way that the bandpass filtering is performed before the other processing steps. In some applications this can be advantageous. For example, if the bandpass filtering is performed first, it is possible to downsample both the left and right channels before applying a possibly very sophisticated algorithm for the extraction of the monophonic component. Therefore, the processing steps contained in the monophonic signal path ME may be performed in any appropriate order respect to each other.

The disclosed invention is especially intended for converting audio material having signals in the general two-channel stereo format for headphone listening. This includes all audio material, for example speech, music or effect sounds, which are recorded and/or mixed and/or otherwise processed to create two separate audio channels, which said channels can also further contain monophonic components, or which channels may have been created from a monophonic single channel source, for example, by decorrelation methods and/or by adding reverberation. This also allows the use of the method according to the invention for improving the spatial impression in listening different types of monophonic audio material.

The media providing the stereo signals for processing can include, for example, CompactDisc, MiniDisc, MP3, AAC or any other digital media including public TV, radio or other broadcasting, computers and also telecommunication devices, such as mobile or multimedia phones, PDA's, web pads etc. Stereo signals may also be provided as analog signals, which, prior to the processing in a digital network, are first AD-converted.

The signal processing device according to the invention can be incorporated into different types of portable, mobile appliances, such as portable players or communication devices, but also into non-portable devices, such as home stereo systems or PC-computers. The implementation of the monophonic equalizer may be hardware or software based, or the practical implementation may be a suitable mixture of these depending on the specific application.

The invention claimed is:

1. A method, comprising:

forming left and right channel signal paths in stereophonic processing of left and right channel input signals into left and right channel output signals suitable for stereophonic headphone listening, and forming at least one delay introducing a cross-talk signal path between the left and right channel signal paths, wherein the method further comprises forming a separate monophonic signal path in order to equalize a frequency spectrum of a monophonic component of the left and right channel output signals by at least extracting from the left and right channel input signals an at least substantially monophonic signal component contained in and common for both said left and right channel input signals, processing the monophonic signal component to obtain a processed monophonic signal component, wherein the processing includes adjustment of the gain of said monophonic signal component, and combining said processed monophonic signal component with at least one of the left and the right channel output signals.

2. The method according to claim 1, wherein the at least substantially monophonic signal component is extracted from the left and right input signals based on a momentary average value (L+R)/2 of said signals.

3. The method according to claim 1, wherein the at least substantially monophonic signal component is extracted from the left and right channel input signals based on similarity between said signals.

4. The method according to claim 1, wherein the processing of the monophonic signal component includes processing of a frequency spectrum of said monophonic signal component.

5. The method according to claim 4, wherein the processing of the frequency spectrum of said monophonic signal component is performed substantially within a frequency range ranging from 500 Hz to 2 kHz.

6. The method according to claim 1, wherein the processing of the monophonic signal component includes adjustment of the gain of said monophonic signal component by the gain magnitude of −5 dB.

7. The method according to claim 6, wherein the adjustment of the gain is performed in a time varying manner.

8. The method according to claim 1, wherein the processing of the monophonic signal component includes adding a delay to said monophonic signal component.

9. A device, comprising:

at least left and right channel signal paths in order to process left and right channel input signals into left and right channel output signals suitable for stereophonic headphone listening, and at least one delay introducing a cross-talk signal path between the left and right channel signal paths, wherein the device further comprises a separate monophonic signal path in order to equalize a frequency spectrum of a monophonic component of the left and right channel output signals, said monophonic signal path comprising a signal processor for extracting from the left and right channel input signals an at least substantially monophonic signal component contained in and common for both said left and right channel input signals, and for processing the monophonic signal component to obtain a processed monophonic signal component, the processing including adjusting the gain of said monophonic signal component, and for combining said processed monophonic signal component with at least one of the left or the right channel output signals.

10. The device according to claim 9, wherein the extracting the at least substantially monophonic signal component from the left and right channel input signals is based on determining a momentary average value (L+R)/2 of said signals.

11. The device according to claim 9, wherein the extracting the at least substantially monophonic signal component from the left and right channel input signals is based on similarity between said signals.

12. The device according to claim 9, wherein the processing of the monophonic signal component includes processing of a frequency spectrum of said monophonic signal component.

13. The device according to claim 12, wherein said signal processor comprises a digital Infinite Impulse Response or a Finite Impulse Response filter structure for said processing of the frequency spectrum of said monophonic signal component.

14. The device according to claim 12, wherein the processing of the frequency spectrum of said monophonic signal component is performed substantially within a frequency range ranging from 500 Hz to 2 kHz.

15. The device according to claim 9, wherein the processing the monophonic signal component includes adjusting the gain of said monophonic signal component by the gain magnitude of −5 dB.

16. The device according to claim 15, wherein the signal processor is configured to adjust the gain in a time varying manner.

17. The device according to claim 9, wherein the signal processor is configured to add a delay to said monophonic signal component.

18. The device according to claim 9, wherein the device is a digital signal processing device.

19. A computer program stored on a computer readable medium, configured to carry out a method comprising:

forming left and right channel signal paths in order to process left and right channel input signals into left and right channel output signals suitable for stereophonic headphone listening, forming at least one delay introducing a cross-talk signal path between the left and right channel signal paths, and further forming a separate monophonic signal path in order to equalize a frequency spectrum of a monophonic component of the left and right channel output signals by at least extracting from the left and right channel input signals an at least substantially monophonic signal component contained in and common for both said left and right channel input signals, processing the monophonic signal component to obtain a processed monophonic signal component, the processing including adjusting the gain of said monophonic signal component, and further combining said processed monophonic signal component with at least one of the left and the right channel output signals.

20. A computer program according to claim 19, configured for execution in a digital signal processor.

21. A mobile appliance, comprising:

at least left and right channel signal paths in order to process the left and right channel input signals into left and right channel output signals suitable for stereophonic headphone listening, and at least one delay introducing a cross-talk signal path between the left and right channel signal paths, a separate monophonic signal path in order to equalize a frequency spectrum of a monophonic component of the left and right channel output signals, said monophonic signal path for extracting from the left and right channel input signals an at least substantially monophonic signal component contained in and common for both said left and right channel input signals, for processing the monophonic signal component to obtain a processed monophonic signal component, the processing including adjusting the gain of said monophonic signal component, and for combining said processed monophonic signal component with at least one of the left or the right channel output signals.

22. A mobile appliance according to claim 21, comprising a portable digital player or a digital mobile telecommunication device.

23. A device, comprising:

at least left and right channel signal paths in order to process the left and right channel input signals into left and right channel output signals suitable for stereophonic headphone listening, and at least one delay introducing a cross-talk signal path between the left and right channel signal paths, wherein the device further comprises a separate monophonic signal path in order to equalize a frequency spectrum of a monophonic component of the left and right channel output signals, said monophonic signal path comprising at least means for extracting from the left and right channel input signals an at least substantially monophonic signal component contained in and common for both said left and right channel input signals, means for processing the monophonic signal component to obtain a processed monophonic signal component, the processing including adjusting the gain of said monophonic signal component, and means for combining said processed monophonic signal component with at least one of the left or the right channel output signals.

24. The device according to claim 23, wherein the means for processing the monophonic signal component include means for processing of a frequency spectrum of said monophonic signal component.

* * * * *

UNITED STATES PATENT AND TRADEMARK OFFICE

CERTIFICATE OF CORRECTION

PATENT NO. : 7,440,575 B2
APPLICATION NO. : 10/720009
DATED : October 21, 2008
INVENTOR(S) : Ole Kirkeby It is certified that error appears in the above-identified patent and that said Letters Patent is hereby corrected as shown below:

In column 14 at line 26, after "A", please insert --computer readable medium having a--.

In column 14 at line 26, after "stored", please delete "on a computer readable medium," and insert --thereon, said computer program-- therefor.

In column 14 at line 48, please delete "A" and insert --The-- therefor.

In column 14 at line 48, please delete "program" and insert --readable medium-- therefor.

In column 14 at line 48, after "19," please insert --wherein said computer program is--.

In column 15 at line 4, please delete "A" and insert --The-- therefor.

Signed and Sealed this

Thirty-first Day of March, 2009

JOHN DOLL
*Acting Director of the United States Patent and Trademark Office*